US005782039A

United States Patent [19]

Scherer et al.

[11] Patent Number: 5,782,039

[45] Date of Patent: Jul. 21, 1998

[54] PORTABLE GATE

[75] Inventors: Craig S. Scherer, Wilmette; David C. Brown, Chicago; Michael C. Thuma, Desplaines, all of Ill.

[73] Assignee: BRK Brands, Inc., Aurora, Ill.

[21] Appl. No.: 682,435

[22] Filed: Jul. 17, 1996

[51] Int. Cl.[6] ..... E05C 21/02; E06B 3/12

[52] U.S. Cl. ..... 49/465; 160/222

[58] Field of Search ..... 49/463, 465, 55, 49/57; 160/222, 224, 225

[56] References Cited

U.S. PATENT DOCUMENTS

| | | | |
|---|---|---|---|
| 139,232 | 5/1873 | Boughton . | |
| 141,677 | 8/1873 | Tuttle . | |
| 235,660 | 12/1880 | Ward . | |
| 334,676 | 1/1886 | Paulus et al. . | |
| D. 341,207 | 11/1993 | Freese et al. . | |
| D. 348,524 | 7/1994 | Young et al. . | |
| D. 355,261 | 2/1995 | Abrams et al. . | |
| 367,162 | 7/1887 | Peterson . | |
| 498,574 | 5/1893 | Ryan . | |
| 604,411 | 5/1898 | Motley . | |
| 646,120 | 3/1900 | Gallagher . | |
| 865,404 | 9/1907 | Laurent . | |
| 903,564 | 11/1908 | Haben . | |
| 905,142 | 12/1908 | Bond . | |
| 942,502 | 12/1909 | Jablonovsky . | |
| 1,148,513 | 8/1915 | Hoyt . | |
| 1,238,294 | 8/1917 | Hertz . | |
| 1,241,660 | 10/1917 | Roberts . | |
| 1,303,390 | 5/1919 | Reed | 160/224 |
| 1,332,924 | 3/1920 | Sikorovsky . | |
| 1,335,583 | 3/1920 | Karro . | |
| 1,416,651 | 5/1922 | Lanfair . | |
| 1,438,202 | 12/1922 | Wieland . | |
| 1,450,920 | 4/1923 | Hutchinson . | |
| 1,465,443 | 8/1923 | Josler . | |
| 1,515,454 | 11/1924 | Wilson . | |
| 1,683,204 | 9/1928 | Mills . | |
| 1,735,458 | 11/1929 | Gresak . | |
| 1,752,683 | 4/1930 | Meagher . | |
| 1,798,600 | 3/1931 | Gooch . | |
| 1,849,024 | 3/1932 | McKee . | |
| 1,923,804 | 8/1933 | Williams et al. | 160/225 |
| 1,961,781 | 1/1934 | Reagle . | |
| 2,199,851 | 5/1940 | Culver . | |
| 2,295,194 | 9/1942 | Atkinson . | |
| 2,348,561 | 5/1944 | Mutch . | |
| 2,490,612 | 12/1949 | Ballard . | |
| 2,511,372 | 6/1950 | Price . | |
| 2,520,664 | 8/1950 | Turner . | |
| 2,559,066 | 7/1951 | Diefenbronn . | |
| 2,563,446 | 7/1951 | Abel . | |
| 2,574,807 | 9/1951 | Woodruff . | |
| 2,577,034 | 4/1951 | Quinlan . | |
| 2,581,857 | 1/1952 | Harrison . | |
| 2,662,242 | 12/1953 | Hess . | |
| 2,756,469 | 7/1956 | Cattermole et al. . | |
| 2,803,471 | 8/1957 | Roth . | |
| 2,851,746 | 9/1958 | McPhaden . | |
| 2,896,277 | 7/1959 | Halligan . | |

(List continued on next page.)

FOREIGN PATENT DOCUMENTS

| | | |
|---|---|---|
| 618725 | 4/1949 | United Kingdom . |

*Primary Examiner*—Milton Nelson, Jr.
*Attorney, Agent, or Firm*—Rockey, Milnamow & Katz, Ltd.

[57] ABSTRACT

A two-section portable gate carries a rotatable control handle at an upper surface thereof for purposes of installation and removal of the gate in a doorway. When the handle is rotated to an extended state, the two sections of the gate can be moved relative to one another to fill the opening in the doorway. When the handle is moved to an intermediate position, the gate sections are locked together and further relative movement is not possible. When the handle is moved to a closed or locked position adjacent to an upper surface of the gate, the gate sections are forced apart a predetermined distance thereby creating normal forces, and in turn frictional forces, which lock the gate into position in the doorway and resist its removal. Spring loaded bumpers can be used on edges of the gate sections to take into account non-square openings.

18 Claims, 7 Drawing Sheets

U.S. PATENT DOCUMENTS 2,928,146 3/1960 Kuniholm .
2,982,353 5/1961 Luger .
2,998,063 8/1961 Hafner .
3,000,063 9/1961 Hoog .
3,120,032 2/1964 Burnette .
3,163,205 12/1964 Gottlieb .
3,216,482 11/1965 Lindholm .
3,420,003 1/1969 Cline .
3,431,966 3/1969 Injeski .
3,441,037 4/1969 Transeau .
3,461,511 8/1969 Perina .
3,489,201 1/1970 Curry et al. .
3,543,977 12/1970 Lockridge .
3,545,135 12/1970 Lieber .
3,571,999 3/1971 Downing .
3,638,284 2/1972 Baker .
3,651,853 3/1972 Pedley .
3,680,260 8/1972 Bauer .
3,691,688 9/1972 Kaiserswerth .
3,885,616 5/1975 Berkowitz .
3,906,671 9/1975 Maldonado .
3,942,576 3/1976 Rickard .
3,950,894 4/1976 DiMaio .
3,957,251 5/1976 McCracken .
4,000,590 1/1977 Kordewick .
4,004,325 1/1977 Hubachek .
4,094,021 6/1978 Rapp .
4,149,342 4/1979 Bowers .
4,150,510 4/1979 Harrison et al. .
4,174,096 11/1979 Camapbell .
4,325,533 4/1982 Tiletschke et al. .
4,367,819 1/1983 Lewis .
4,437,265 3/1984 Turro et al. .
4,465,262 8/1984 Itri et al. .
4,470,277 9/1984 Uyeda .
4,492,263 1/1985 Gebhard .
4,566,222 1/1986 Hatvany .
4,573,285 3/1986 Jokel .
4,583,715 4/1986 Wright .
4,607,455 8/1986 Bluem et al. .
4,611,431 9/1986 Lauro .
4,615,142 10/1986 Reeves .
4,628,635 12/1986 Maillard .
4,643,318 2/1987 Kopp .
4,671,012 6/1987 Merklinger et al. .
4,671,015 6/1987 Curry et al. .
4,677,791 7/1987 Larson et al. .
4,685,247 8/1987 Alam .
4,702,036 10/1987 Johnson .
4,777,765 10/1988 Johnson .
4,787,174 11/1988 Brown .
4,831,777 5/1989 Johnson .
4,846,246 7/1989 Stern .
4,848,030 7/1989 Bennett .
4,884,614 12/1989 Spurling .
4,938,154 7/1990 Watt .
4,944,117 7/1990 Gebhard et al. .
4,968,071 11/1990 Stern .
5,052,461 10/1991 Stern .
5,060,421 10/1991 Castelli .
5,117,585 6/1992 Andrisin .
5,131,186 7/1992 Lamont .
5,134,806 8/1992 Burkart .
5,199,753 4/1993 Presley .
5,217,265 6/1993 Lerner et al. .
5,272,840 12/1993 Knoedler et al. .
5,367,829 11/1994 Crossley et al. .
5,396,732 3/1995 Anderson .
5,437,115 8/1995 Freese et al. .
5,442,881 8/1995 Asbach et al. .
5,528,859 6/1996 Taylor et al. ..... 49/55
5,535,552 7/1996 Stern ..... 160/225 X
5,570,543 11/1996 Bishop ..... 49/465

PORTABLE GATE

FIELD OF THE INVENTION

This invention relates to portable gates. More particularly, the invention relates to portable gates for use in doorways, openings, between walls and the like to divide room areas.

BACKGROUND OF THE INVENTION

Portable gates have many uses and are commonly found in households with small children and pets. Such gates may be used to separate areas or rooms to prevent entry.

Typically, a gate may be placed at the entrance of a living room area to discourage children or pets from entering the area. Such gates may also be placed at, for example, the entrance to a kitchen to keep a pet within the kitchen area. Such gates are also used to at the top and bottom of stairs to prevent children from going down, or climbing up the stairs without supervision.

One commonly known type of portable gate includes an expandable or extendable lattice or accordion-like arrangement. The lattice elements are hinged to adjacent elements to permit the gate to expand to close off the doorway or entry way to the area. Such lattice-like gates are typically hinged to one side of the doorway and are latched to the other side of the doorway to close off the area.

One drawback to this type of gate is that it may not be sufficiently rigid or structurally stable. Therefore, this type of gate may not be the preferred type for all uses. Moreover, because or the lattice-type extendibility of the gate, it is not in a state of tension or compression when in use, and may not be used in a wide variety of locations.

Another known type of portable gate includes a pair of sliding panels which have a biasing mechanism or a lever arrangement to place the gate in compression between, for example, the posts of a door frame.

Such a lever arrangement type may include a horizontally oriented central rail having notches therein and a rotatable lever positioned adjacent to the central rail having a pin or other member adapted to engage the rail. While such gates are adequate for certain uses, the lack of any biasing member may result in an improper "fit" of the gate to the doorway. Moreover, if the door posts are not equidistant and parallel (i.e., if the doorway or door frame is out of square), the gate may not properly fit therebetween, and may be easily dislodged.

Known biased type gates may include one or more telescopically, adjustable hollow tubular members which span the doorposts. The tubular member may have a spring therein for biasing the gate into the extended state, to create a tight fit between the door posts. While such gates provide an adequate barrier between rooms, they may be unwieldy or difficult to handle and set in place in the doorway.

Accordingly, there continues to be a need for portable gates which use both a lever-type action to close the gate, while incorporating one or more biasing elements to maintain a good, tight fit of the gate between the door posts. Preferably, such gate will be usable in "out-of-square" doorways, and is configured for ease of use and handling, and for high reliability.

SUMMARY OF THE INVENTION

An adjustable portable gate, in accordance with the present invention, incorporates two slidable gate sections. The gate sections are coupled together and can be slid apart to adjust for varying widths of doorways or openings which the gate is to fill.

Each section includes upper and lower, spaced apart rails and inner and outer side rails which are perpendicular to the upper and lower rails. The lower rail is closest, generally parallel to an adjacent floor when the gate has been installed. The upper rail is displaced but is generally parallel to the floor.

The sections overlap to some extent when the gate is installed for use. The outer vertical rail sections are positioned adjacent to surfaces of an opening to be blocked or closed by the gate.

One of the sections carries upper and lower, linear, rack-like elements, sets of linerally extending gear teeth. The other section carries first and second spaced apart elements, one associated with each rack. The ratchet elements have teeth which engage portions of a respective, adjacent rack.

A vertically operable mechanism is carried along an inner side rail of the gate section which carries the ratchet elements. The same section carries a rotatable top-mounted handle.

The ratchet elements can be completely disengaged from the respective rack elements by appropriately rotating the handle in an upward direction thereby actuating the vertically oriented mechanism. With the handle in this position, the gate sections can be slid toward one another for removal from a doorway or for storage. The sections can also be slid apart so as to fill an opening or doorway.

When it is desired to install the gate in an opening, the two sections are moved apart relative to one another as far as possible to fill the opening. Each of the sections carries spring biased or spring loaded bumpers on respective outer side rails.

When the gate is not installed, the bumpers are in a fully extended position. When the gate sections are spread apart for installation purposes to fill the opening, the bumpers are placed in contact with adjacent surfaces of the two sides of the opening or the door frame to be filled. In this condition, there is no significant amount of frictional force between the bumpers and the door frame or opening.

To lock the gate in position, the top mounted handle is rotated downwardly toward the respective gate section. This actuates the vertically oriented mechanism.

Actuation of this mechanism causes the ratchet elements to first engage respective of the rack elements and then to force the two sections of the gate apart from one another thereby creating perpendicular forces directed at the sides of the door frame or opening to be closed. These forces in turn compress the bumpers and as a result produce substantial frictional forces which lock the gate into the doorway or the opening thereby preventing passageway of children or pets therethrough until the gate is removed.

Removal of the gate is accomplished by rotating the handle vertically upwardly away from the respective gate section to an intermediate position. This in turn again operates the vertically oriented mechanism.

The respective ratchet elements first retract the two gate sections toward one another on the order of one-half inch. As a result, the two sections are no longer forced apart as in the locked condition described above. Since the force which is perpendicular to the door frame has been now removed, the gate can be lifted out of the frame and taken away.

When the gate has been released, the two sections will still be locked together. That is, ratchet elements still engage the respective rack elements.

If the actuating handle is rotated to a fully extended position, the ratchet elements will be retracted from the rack-like elements. The two sections of the gate can then be moved relative to one another.

In an alternate embodiment, hinges can be provided on one of the two gate sections. In this embodiment, the gate can be hinged and swung.

The bumpers are carried on removable base members. The base members fit into openings on the respective outer side rails of each the gate sections.

A bumper element is carried near one end of a respective base member. To adjust the height of the bumpers, relative to the floor, it is only necessary to remove the bumper and associated base member from the gate section, rotate it 180° and reinstall it on the gate section.

Since the bumper is not symmetrically located with respect to the base section, the rotation and reinstallation will significantly alter the height to the floor of the respective bumper, thereby making it possible to easily adjust bumper position relative to the floor for different installations. Each of the bumpers carries a spring biased resilient member which directly engages a surface of the door that is being closed.

In one aspect of the invention, the mechanism can be formed with a two-part construction. A first part is carried by a second part. As the second part is moved vertically, relative to the floor for example, it moves the first part vertically to bring the ratchet elements into engagement with respective of the rack-like elements.

Once the ratchet elements have engaged the rack-like elements, further vertical movement by the second part causes the first part to change direction and move perpendicular to the direction of motion of the second part. This perpendicular motion forces the gate sections apart. Reverse movement will retract the gate sections toward one another.

Other features and advantages of the present invention will be apparent from the following detailed description, the accompanying drawings, and the appended claims.

DETAILED DESCRIPTION OF THE PREFERRED EMBODIMENTS

Figure 1:
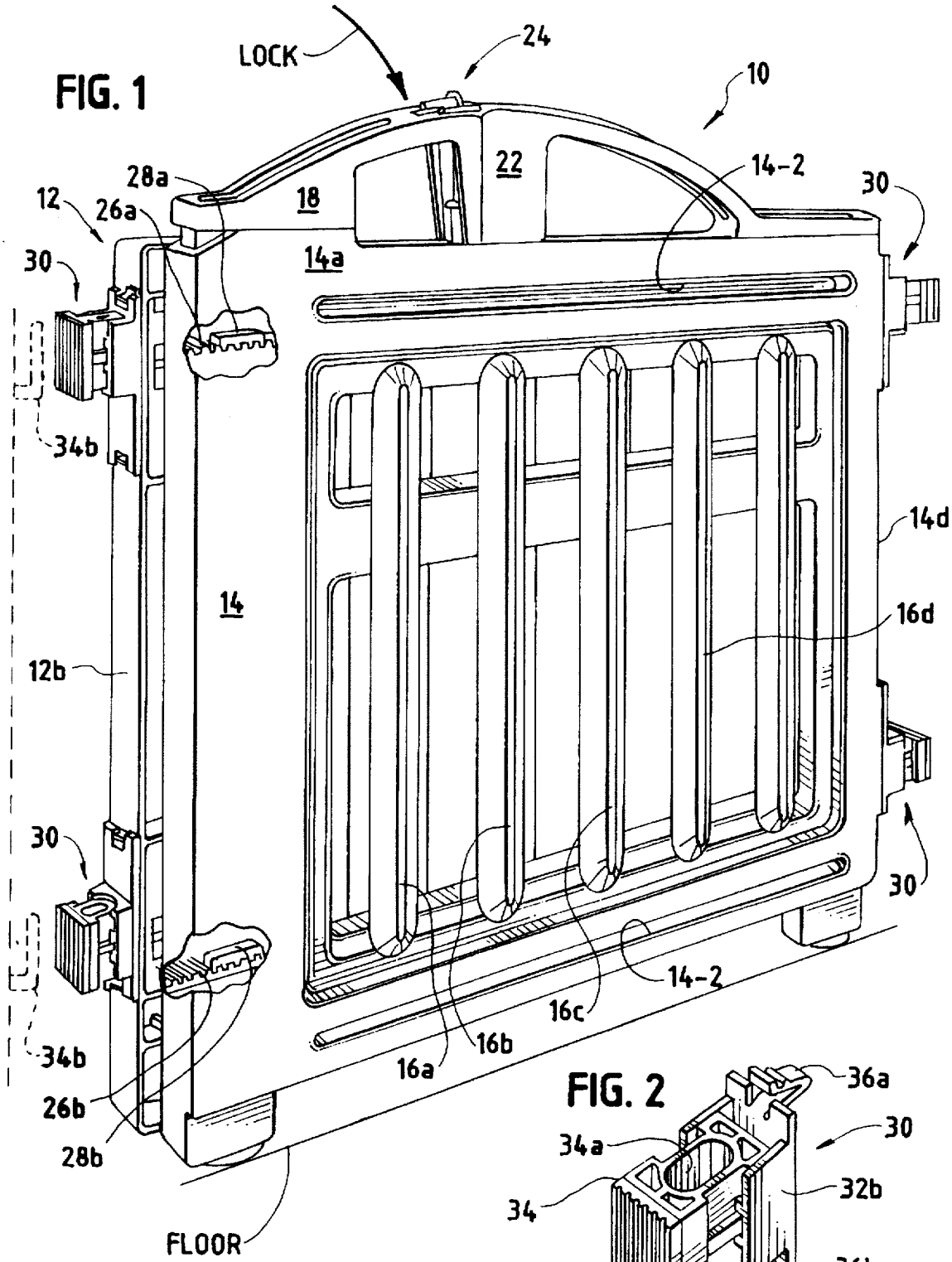
FIG. 1 is a perspective view of the safety gate embodying the principles of the present invention, the gate is illustrated with the sections pulled together in a storage state, with the front portion thereof partially broken away to illustrate the ratchet mechanism therein, and with the handle shown in the locked position.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

With reference now to the figures, and particularly to FIG. 1, there is shown a safety gate 10 which embodies the principles of the present invention. The gate 10 includes a pair of panels 12, 14 which are slidably engagable one with the other.

In a preferred embodiment, the panels 12, 14 each include a plurality of spaced apart barrier members, such as the exemplary vertical members 16*a*, 16*b*, 16*c*, . . . 16*n*. The gate members 16 are configured to prevent and discourage a child from climbing over the gate, and to prevent a child or pet from working (e.g., squeezing) his or her way through the members 16.

The gate 10 includes a rotatable locking handle 18 which is pivotally mounted to one of the panels 12. The locking handle is operably connected to a locking mechanism 20 (See FIGS. 4, 5) which locks and releases the panels 12, 14 from sliding relative to each other.

A fixed mating handle 22 is mounted to the panel 14, in mating relation to the locking handle 18. The mating handle 22 is configured to enclose a tab-like lock release 24 for locking and releasing the locking handle 18.

As described subsequently, when the handle 18 is rotated against an upper rail 14*a* of the section 14, the two sections 12, 14 are first locked together, not movable relative to one another. Then the sections 12, 14 are extended a predetermined amount.

Figure 4:
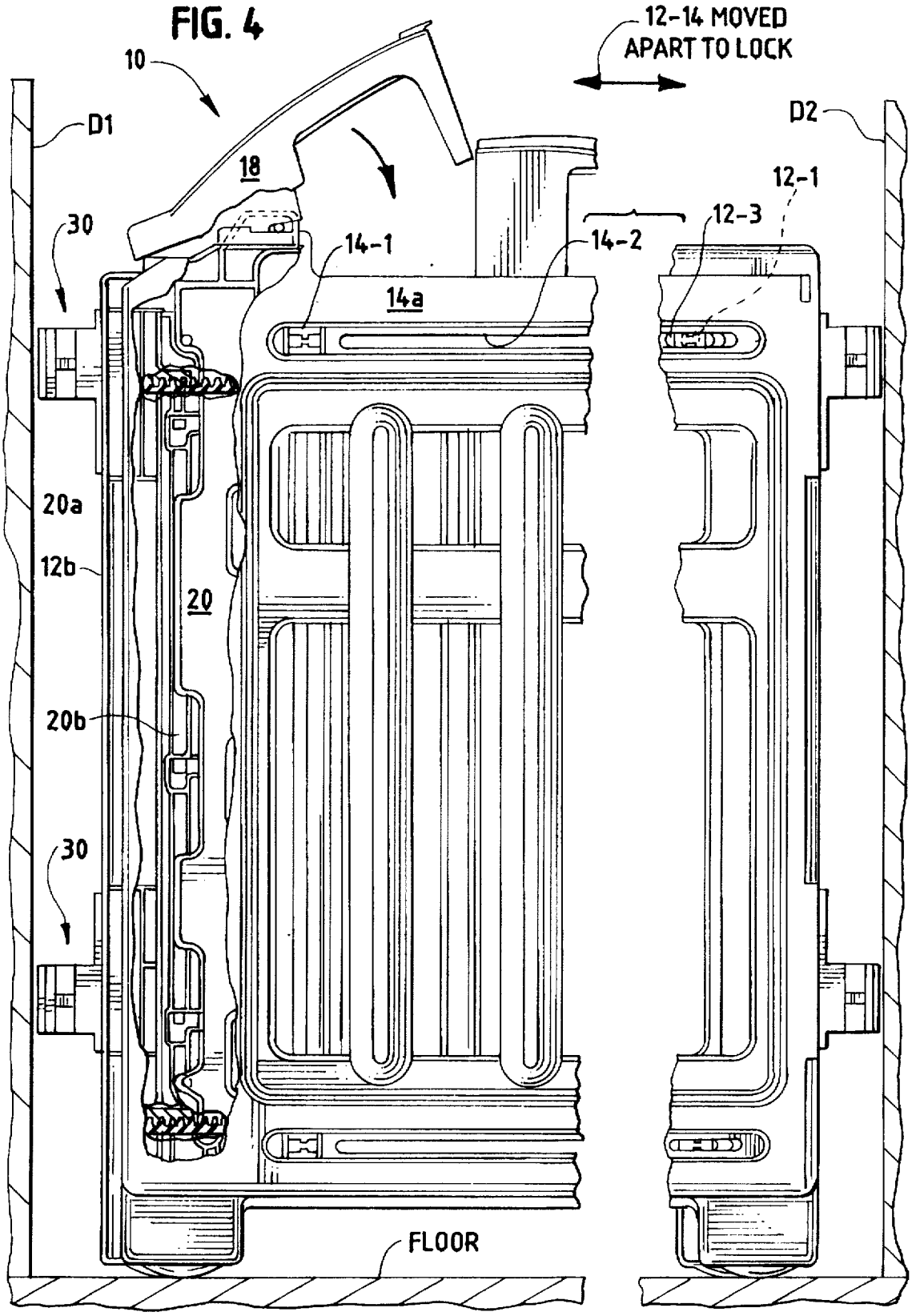
FIG. 4 is a front view, shown partially broken away, of the gate, illustrating the locking mechanism therein, shown with the locking mechanism in the unlocked position.
Figure 7:
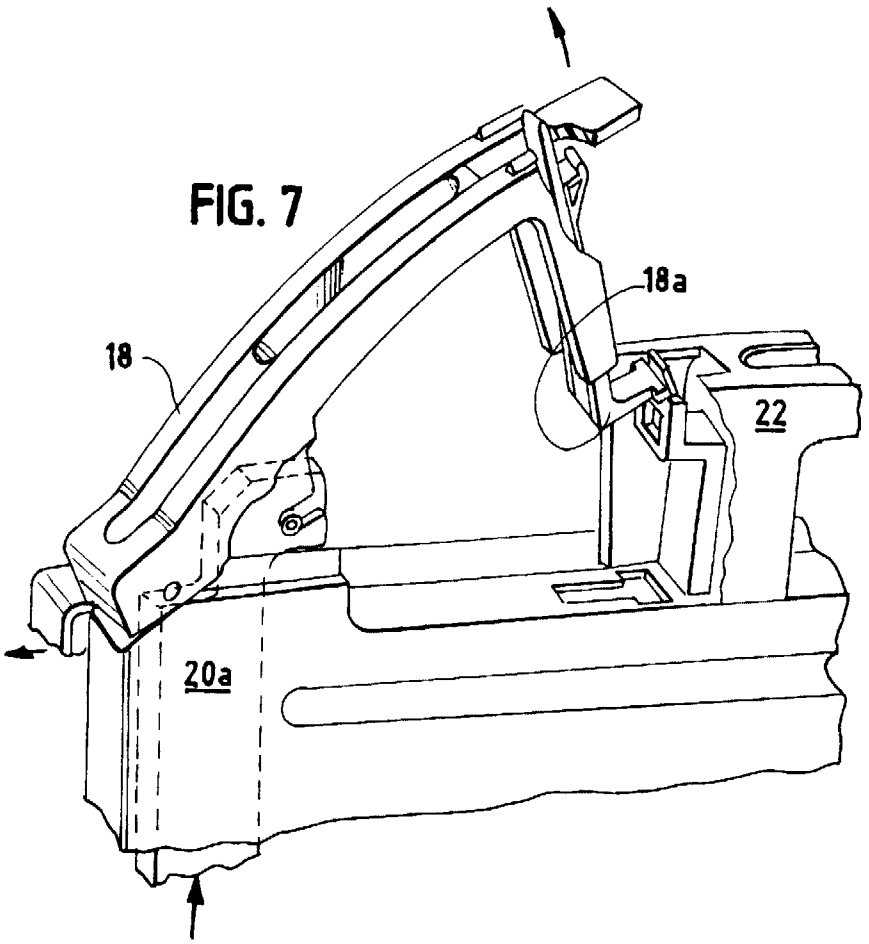
FIG. 7 is a partial perspective view of the gate similar to FIG. 6, with the handle shown in the unlocked position.

When the handle 18 is rotated to its maximum displacement, relative to upper rail 14*a*, as in FIGS. 4,7 the two sections 12, 14 are slidable toward and apart from one another. In this state, the two sections can be slid adjacent to one another to minimize space needed to store the gate (as illustrated in FIG. 1).

When handle 18 is at an intermediate position between that of FIGS. 1, and 4 (as in FIGS. 3, 6) the gate sections 12, 14 can not be slid apart relative to one another. In this state though the gate sections are locked together, they are not extended as the case of FIG. 1. Hence, in this state, the gate 10 can be removed from or placed back into a doorway to be blocked.

To lock the gate into position, the handle 18 need only be rotated against the upper rail 14*a*. This will force the two sections 12, 14 apart the predetermined distance (about one-half inch) locking the gate into the opening.

The panels 12, 14 are slidably secured to each other by screws or pins (best seen in FIG. 4) 12-1, 14-1. Each pin or screw is carried on and extends through a respective panel into a track or slot, such as tracks 12-2, 14-2 (best seen in FIGS. 3 and 4) in the other panel 12, 14. A retaining element, such as element 12-3 rides in the adjacent slot in the opposite panel and provides a retainer that holds the panels 12, 14 together while permitting them to slide relative to one another. The pins 12-1, 14-1 secure the panels 12, 14 together at four locations to provide a secure, tight fit of the panels 12, 14 to each other.

Figure 2:
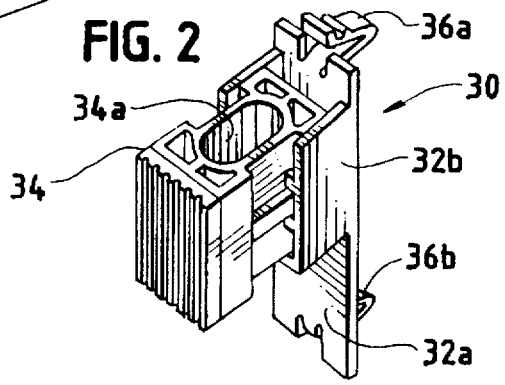
FIG. 2 is a perspective view of a bumper assembly of the safety gate of FIG. 1.

Each of the gate sections 12, 14 respectively carries spring biased bumpers 30 along outer side rails **12*b* and 14*b*. The bumpers 30**, all of which are identical, are illustrated in FIG. 2.

Each of the bumpers is formed with an elongated planar base section **32*a*. The base section 32*a* carries an off-set U-shaped support structure 32*b* at an end thereof. The support structure 32*b* carries a displaceable, spring biased deformable bumper element 34** which might also be compressible.

The element 34 is slidably mounted in the support element **32*b*. In addition to the deformation which might be exhibited by the bumper 34 itself, the spring biasing of the bumper 34 in the support member 32*b* enables that element 34** to move when forces are applied thereto.

The base element **32*a* carries first and second engagable snaps 36*a*, *b*, which are used to removably engage openings in the respective outer vertical rails 12*b* and 14*b*** of the respective gate sections.

The bumpers 30 are adjustable with respect to the distance to the floor simply by removing the respective bumper from the associated gate section rotating it 180° and returning it, with a snap fit back into the gate section.

The bumpers 30 can include a hinge pin receiving recess **34*a* for receiving first and/or second hinge pins 34*b*** mountable on one of the surfaces, with the pins slidably engaging the recesses. The pins are shown schematically in FIG. 1.

As illustrated in FIG. 1, the two gate sections 12, 14 can be locked together for installation in a doorway or the like by means of elongated linear rack-like teeth **26*a* and 26*b* which are carried on section 12. Engaging the rack-like teeth 26*a*, 26*b* are matting, ratchet-like elements 28*a* and 28*b* which are coupled to a two-part locking mechanism 20**.

Figure 3:
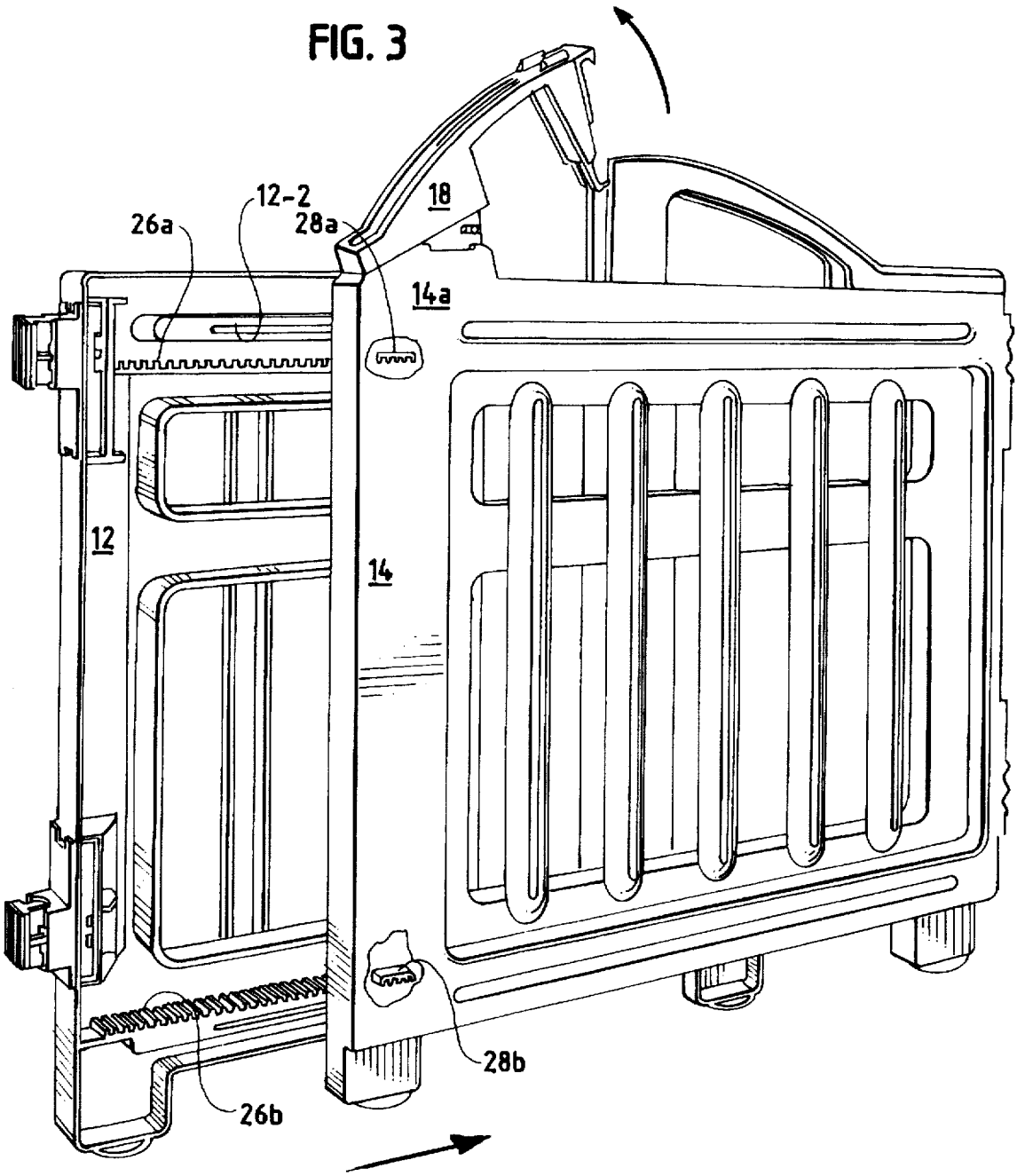
FIG. 3 is a perspective view, similar to FIG. 1, illustrating the gate in a partially extended state, and with the front portion thereof partially broken away to illustrate the ratchet mechanism therein and with the handle shown in the unlocked intermediate position.

The mechanism 20 has three states. The state illustrated in FIG. 1 is the locked and extended state. The state illustrated in FIG. 3 is a locked but, not extended, state where the gate can be placed in a doorway. As illustrated in Figure when the handle 18 is positioned in its intermediate state, also illustrated in FIG. 6, sections 12 and 14 can not be moved relative to one another due to the ratchet elements **28*a*, 28*b*, engaging the rack-like teeth 26*a*, 26*b***.

Movement of the sections 12, 14 toward or away from one another is accomplished by moving handle 18 to its fully extended state, as illustrated in FIG. 7. In this state, the ratchet elements **28*a*, 28*b* are fully disengaged from the elongated rack-like teeth 26*a*, 26*b***. The gate sections can be moved forward and away from one another in this state.

Figure 6:
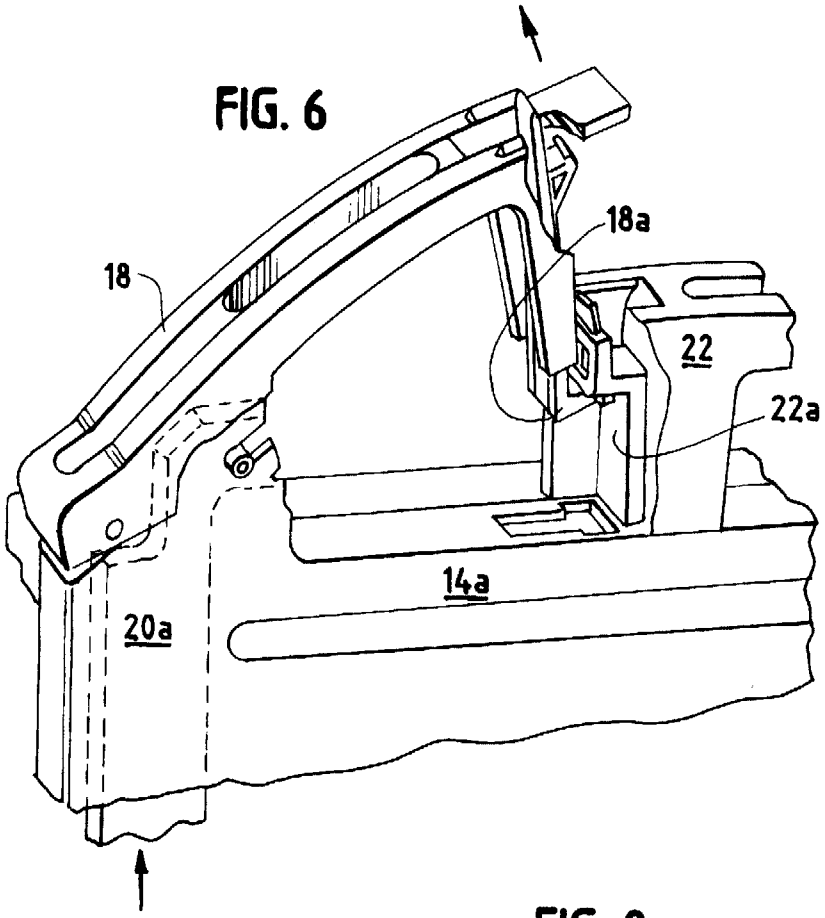
FIG. 6 is a partial perspective view of the gate handle shown in the released position.

FIG. 4 illustrates the gate 10 prior to being installed between the sides of a doorway D1, D2. Installation is accomplished by moving the handle 18 to its intermediate state, again as illustrated in FIGS. 3 and 6. In this state, the sections 12, 14 can be moved apart relative to one another. When the bumpers 30 engage the side walls D1, D2, the handle 18 is pivoted toward the upper rail **14*a* to cause the two sections 12, 14 first to lock together and then to be forced apart, thereupon compressing bumpers 30** and generating forces substantially normal to the surfaces D1, D2. These normal forces in turn produce frictional forces which prevent the gate from being dislodged from the opening.

Figure 5:
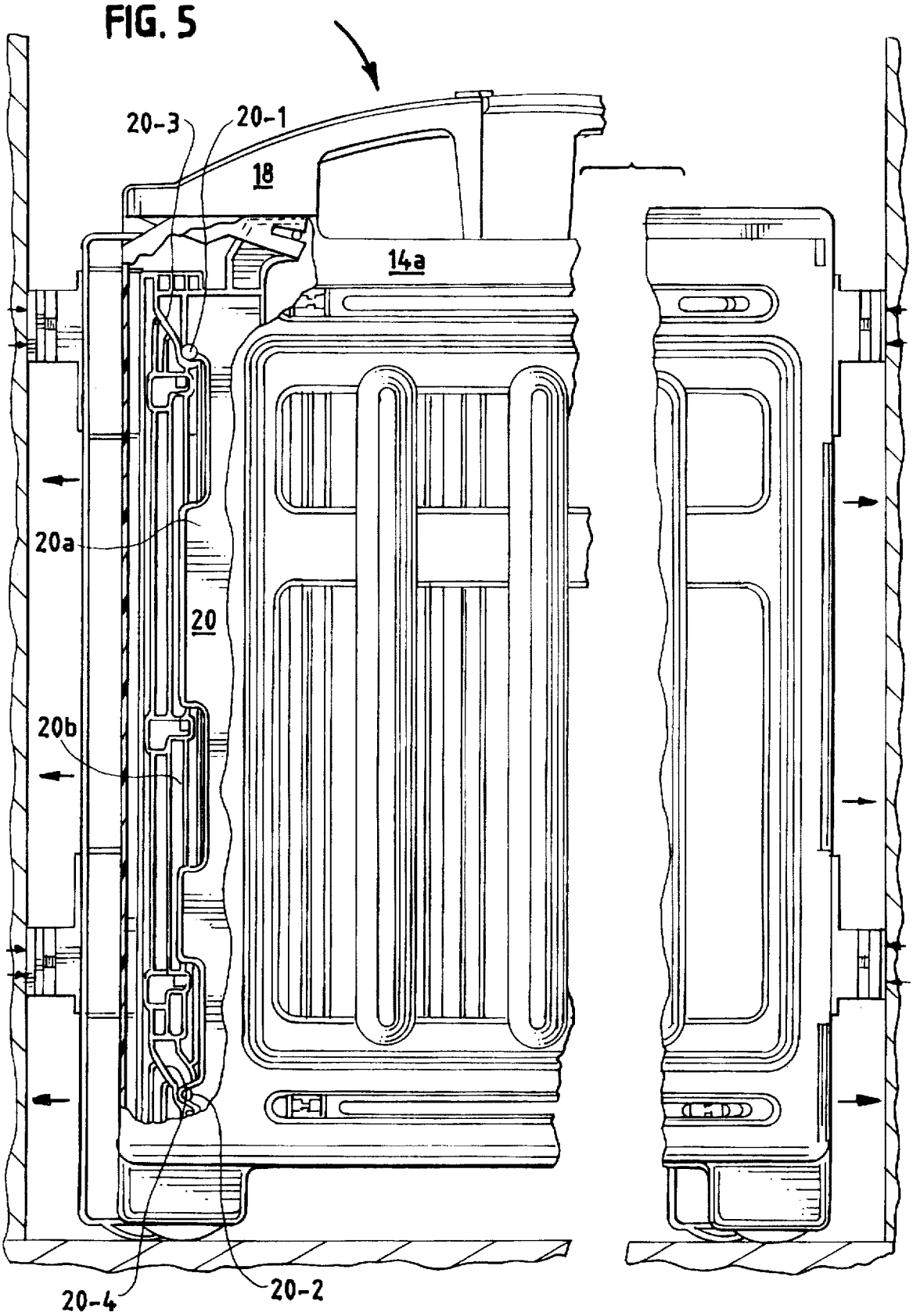
FIG. 5 is a front view similar to FIG. 4, shown partially broken away, illustrating the locking mechanism in the locked position.

The process of rotating the handle 18 downwardly toward the upper rail **14*a* causes the two-part linkage 20 to move downwardly, illustrated in FIG. 5. Linkage section 20*a* is vertically movable and carries section 20*b*. Section 20*b* carries the ratchet elements 28*a*, 28*b***.

When section **20*a* moves downwardly (due to handle 18 moving from its extended position FIG. 7 to its intermediate position FIG. 4) section 20*b* also moves downwardly permitting the ratchet elements to engage the rack elements 28*a*, 28*b*. In this state the sections 12, 14** are loaded together.

As the handle 18 rotates toward the locked position, adjacent to section **14*a*, Section 20*a* which carries cams 20-1, 20-2 moves vertically. The cams 20-1, 20-2 slidably engage cam surfaces 20-3 and 20-4 on linkage element 20*b***.

Figure 9:
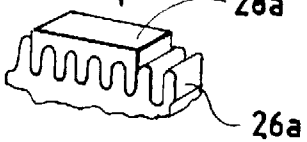
FIG. 9 is a view of the locking elements of the gate illustrated in the locked position.
Figure 8:
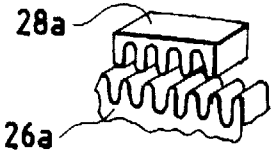
FIG. 8 is a view of the locking elements of the gate illustrated in the unlocked position.

The downward movement of the mechanism 20 along with the interaction between the cam elements 20-1, 20-2 and the cam surfaces 20-3 and 20-4 forces the two linkage elements **20*a*, 20*b* apart from one another. Since the linkage element 20*b* (which carries the ratchet elements 28*a*, 28*b*) moves horizontally as linkage element 20*a* continues to move vertically, the two gate sections 12, 14 are forced apart about one-half an inch. The vertical engagement of the elements 26, 28** is illustrated further in FIGS. 8 and 9.

Thus, the process of locking the gate 10 into a doorway as the handle 18 is rotated downwardly includes two phases. When the handle 18 is at its intermediate state FIG. 3, the linkage elements **20*a*, 20*b* have moved vertically downwardly so that ratchet elements 26 have fully engaged rack elements 28. The sections 12, 14** are not movable relative to each other at this time.

The second phase occurs as the handle 18 is rotated against upper rail **14*a*. The second phase involves forcing the sections 12, 14 apart from one another as the cam elements 20-1 and 20-2 move along the angled cam surfaces 20-3 and 20-4**.

In the second phase, as the elements 20-1 and 20-2 arrive at the end of or bottom on the surfaces 20-3 and 20-4, the gate sections 12, 14 are locked into an extended state. This in turn maintains the frictional forces which have been established by the processing of compressing bumpers in response to rotation of the handle 18 downwardly against the upper rail section **14*a***.

FIGS. 6 and 7 illustrate the intermediate position and fully open positions of handle 18 respectively. In the intermediate position of handle 18, illustrated in FIG. 6, a tab **18*a* carried on the handle 18 has engaged a deflectable latch member 22*a* carried adjacent the handle section 22. In this state, the mechanism 20 is in an intermediate state between a locked position, as illustrated in FIG. 5 and a fully open position as illustrated in FIG. 7. In the intermediate state of FIG. 6, the mechanism 20 enables the ratchet elements 28*a*, 28*b* to engage the rack-like teeth 26*a*, 26*b*. The sections 12, 14** cannot be moved relative to one another, as illustrated in FIG. 3.

In FIG. 7, the deflectable member **22*a* has been moved so that the tab 18*a* has moved past that deflectable member so that the handle 18 is now in its fully open position. As a result, the mechanism 20 is now in its fully raised position with the result that the ratchet elements 28*a*, 28*b* are fully disengaged from the rack-like teeth elements 26*a*, 26*b*. The two sections of the gate 12, 14 can be slid both toward and apart from one another. Going from FIG. 7 to FIG. 6 results in the linkage elements 20a, 20b dropping vertically so that ratchet elements 28 will engage the rack elements 26**.

Figure 12:
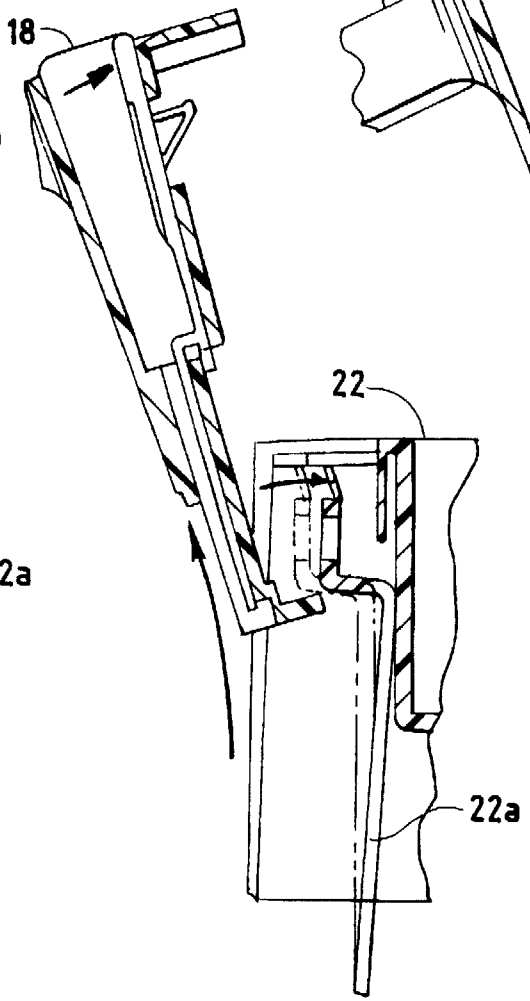
FIG. 12 is a cross-sectional view similar to FIG. 11 with the handle shown in the released position.
Figure 11:
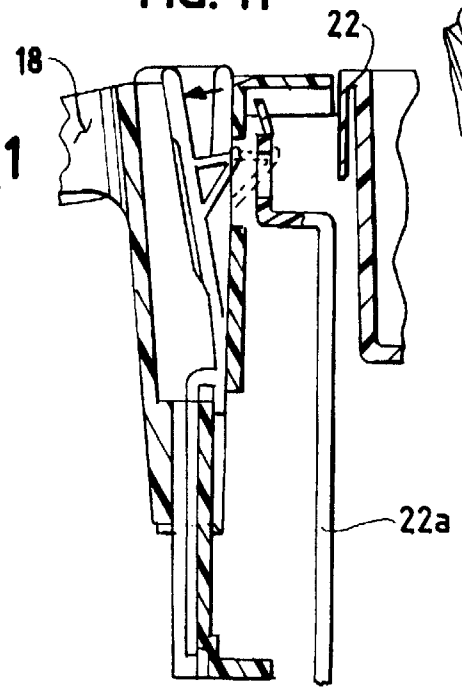
FIG. 11 is a cross-sectional view of the gate handle taken along line 11—11 of FIG. 10, with the handle shown in the locked position.
Figure 10:
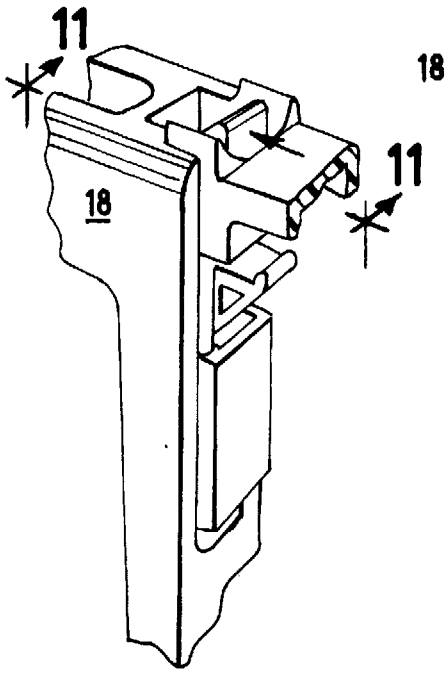
FIG. 10 is a partial perspective view of the gate handle.

FIGS. 10 through 13 illustrated various states of the handle 18. FIG. 11 illustrates handle 18 in a fully locked state with the gate sections 12, 14 extended from one another for the purposes of locking the gate 10 into a doorway. FIG. 12 illustrates an intermediate state of the handle 18 wherein the deflectable latching member 22a, as illustrated in phantom, holds the handle 18 in a position with the mechanism 20 moved vertically into an intermediate position. In this state, the sections 12, 14 are retracted, but the ratchet elements 28a, 28b still engage the rack elements 26a, 26b. Hence, sections 12, 14 cannot be moved relative to one another.

Figure 13:
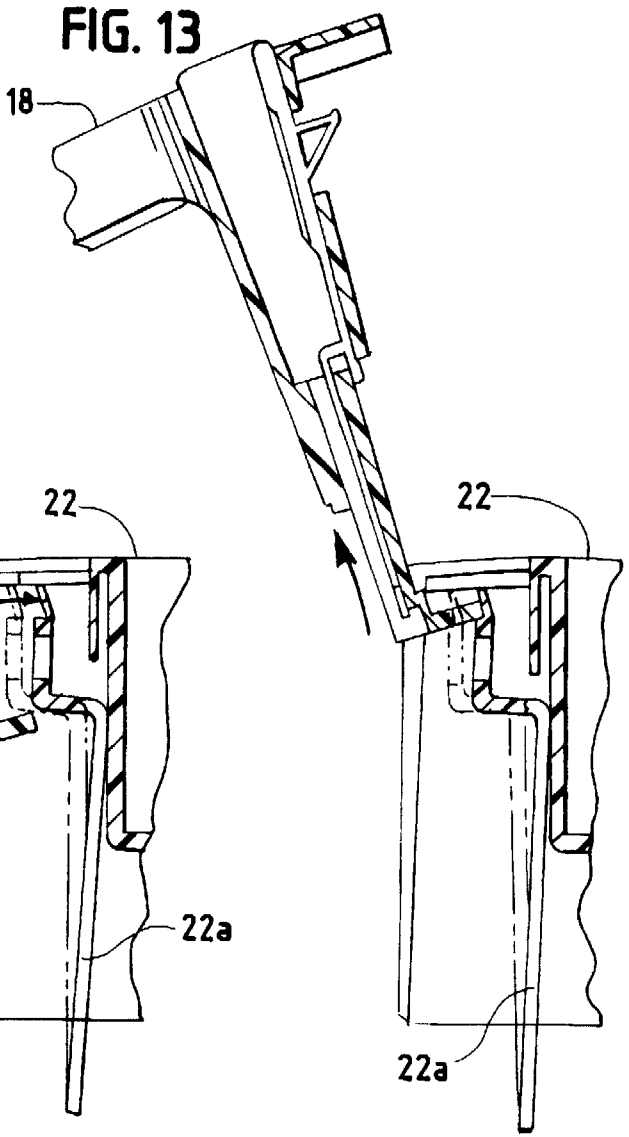
FIG. 13 is a cross-sectional view similar to FIGS. 11 and 12 with the handle shown in the unlocked position.

FIG. 13 illustrates handle 18 in its fully extended state after latch 22a has been retracted. In this state, the ratchet elements 28a, 28b are also fully retracted in response to mechanism 20 having moved to its fully vertical state whereupon sections 12, 14 can be slid both toward and away from one another.

Figure 15:
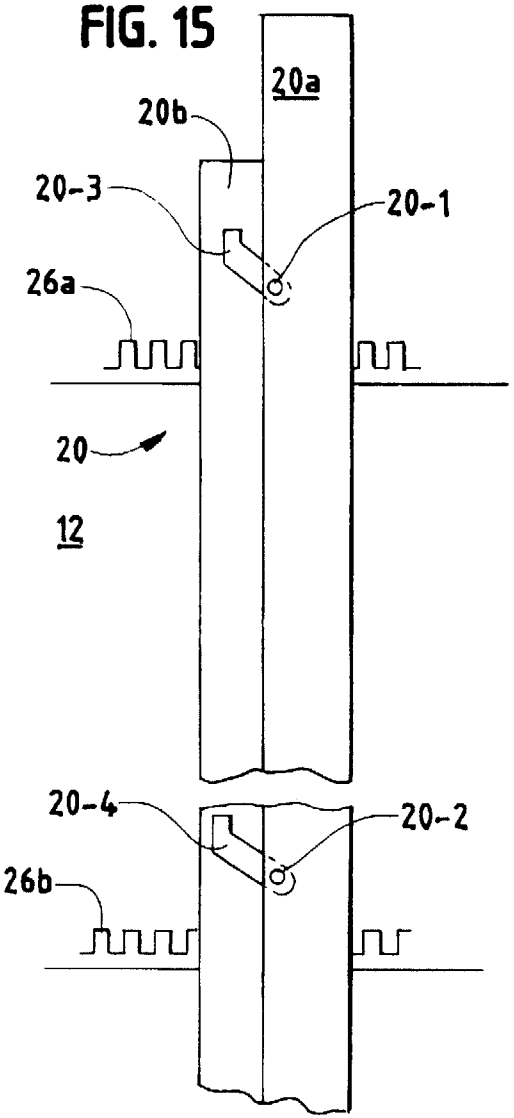
FIGS. 14 and 15 further illustrate the locking mechanism.
Figure 14:
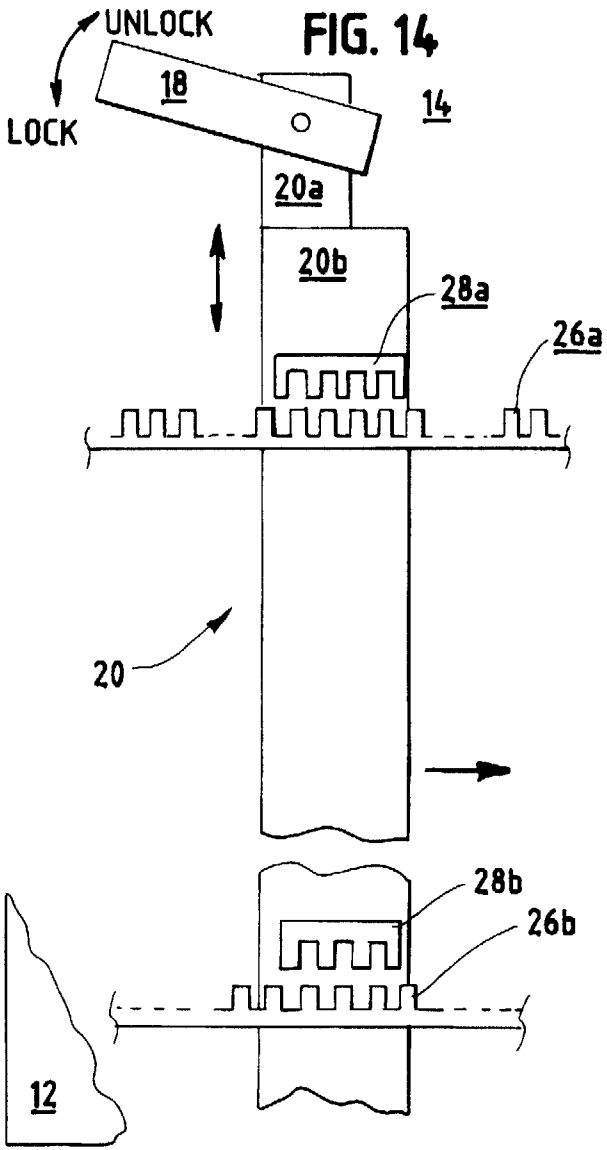

FIGS. 14 and 15 illustrate the principals of the present invention and various aspects of the operation of the two-part mechanism 20. With respect to FIG. 14, a schematic view is illustrated looking through section 12 toward section 14 of the gate 10. In this instance, the rack-like element 26a is illustrated adjacent to and below the corresponding ratchet element 28a.

The rack-like element 26a is carried on gate section 12 as illustrated in previously discussed figures, best seen in FIG. 3. The ratchet element 28a is carried on the mechanism 20 which is in turn coupled to the rotary handle 18.

As described above, the mechanism 20 is a two-part mechanism which includes section 20a which is rotatably coupled to pivotable handle 18 and a second section 20b. The section 20b is carried on the section 20a and can move both vertically and horizontally, when the gate is installed in a normal operating position relative to the floor.

The handle 18 is pivotally attached to the element 20a. The element 20a is carried, as is the handle 18 by the panel 14.

FIG. 15 is a view of the mechanism of FIG. 14 looking through panel 14. As illustrated in FIG. 15, the mechanism element 20b carries cam surfaces 20-3 and 20-4. The element 20a carries cam followers 20-1 and 20-2.

Starting from the handle 18 being rotated to its fully extended state, illustrated in FIG. 13, the elements 20a and 20b are lifted vertically, by the handle 18 and the ratchet 28a, 28b have been disengaged from the corresponding rack elements 26a and 26b. In this state as described previously, the panels 12, 14 are slidable relative to one another.

When the handle 18 is rotated to its intermediate state, as illustrated in FIGS. 3 and 6, both the element 20a and 20b have moved vertically downwardly, again assuming a normal gate orientation. This vertical downward movement permits the ratchet elements 28a, 28b to slidably engage teeth of the rack elements 26a, 26b. This engagement locks sections 12 and 14 together and no additional relative motion therebetween is possible.

As the handle 18 is rotated downwardly to its locked position, illustrated in FIGS. 1 and 11, the linkage element 20a continues to move vertically downwardly. However, cam followers 20-1 and 20-2 interact with cam surfaces 20-3 and 20-4 on linkage element 20b forcing that element to move transversely. The result of this transverse motion is to cause the gate sections 12 and 14 to move apart from one another to an expanded or extended state on the order of one-half an inch. This movement locks the gate into the doorway or opening by providing forces substantially normal to the sides of the doorway or opening. These normal forces in turn create frictional forces via the bumpers 30 which resist dislodgement of the gate from the opening.

Reversing the process in moving the handle 18 in the opposite direction causes the linkages 20a and 20b to move in reverse directions from that described above.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A portable security gate comprising:

first and second panels, slidably mounted relative to one another and moveable relative to one another in a first direction;

a locking handle, pivotally attached to one of said panels wherein said handle has a locking position and a non-locking position and where at least the other of said panels carries a plurality of spaced engaging projections linearly arranged and extending parallel to said first direction;

a linearly moveable locking mechanism, coupled to said handle for engaging at least one of said panels, and, in response to movement of said handle to said locking position and movement of said mechanism substantially perpendicular to said first direction, forcing said panels apart to an extended position, and locking same therein.

2. A gate as in claim 1 wherein said panels are configured so as to be unsuited for climbing upon.

3. A gate as in claim 1 wherein said locking mechanism includes at least one cam surface which translates linear movement of said mechanism to movement substantially perpendicular thereto.

4. A gate as in claim 1 which includes at least one biased bumper element.

5. A gate as in claim 4 wherein said bumper element is removably coupled to one of said panels and wherein a location parameter of said bumper can be altered by rotating said bumper relative to the said one panel.

6. A gate as in claim 1 wherein said mechanism includes first and second linear elements wherein one of said elements is carried by the other.

7. A gate as in claim 6 wherein when said other element moves linearly in a first direction, said one element moves in said first direction to lock said panels together and wherein as said other element continues moving in said first direction, said one element moves substantially transverse thereto thereby forcing said panels apart a predetermined distance.

8. A gate as in claim 7 wherein said one element carries a plurality of spaced apart engaging teeth for engaging at least some of said projections in response to said one element having moved in said first direction.

9. A gate as in claim 8 wherein said handle is rotatably coupled to said mechanism.

10. A gate for blocking an opening with first and second spaced apart sides comprising:

first and second blocking sections wherein said sections are slidably coupled together;

a cam carried by one section and a cam surface carried on the other wherein said cam and said surface slidably engage one another, a movable actuating mechanism, coupled to said cam wherein when said mechanism moves in a first direction, said cam slidably engages said surface whereupon said sections are forced apart from one another, a predetermined distance so as to bear against the sides when the sections are positioned therebetween.

11. A gate as in claim 10 wherein said actuating mechanism is carried at least in part, on said one section.

12. A gate as in claim 10 wherein said mechanism when in a first state, having means for permitting said sections to slide relative to one another in a first direction and opposite said first direction, when in a second state, blocks movement of said sections relative to one another and when in a third state, moves said sections apart, in said first direction, a predetermined amount.

13. A gate as in claim 10 which includes a planar oriented, rotatable handle mounted at an end of said one section wherein said handle is coupled to said mechanism and wherein said mechanism moves linearly, at least in part, in response to rotation of said handle.

14. A gate as in claim 10 which includes removable bumper elements which snap-fit into at least one of said sections.

15. A gate according to claim 10 comprising:

at least first and second reversible bumpers carried on one of said sections.

16. A gate as in claim 15 wherein said bumpers each include a hinge pin receiving recess; and first and second hinge pins mountable on one of the spaced apart sides with said pins slidably engaging said recesses.

17. A gate as in claim 10 which includes a control handle pivotally coupled to said mechanism wherein said mechanism moves linerally in response to rotation of said handle.

18. A gate as in claim 17 wherein in response to rotation of said handle in one direction;

said mechanism moves in a selected direction to force the sections apart and in response to rotation of said handle, opposite said one direction, said mechanism moves opposite said selected direction thereby pulling the sections together.

* * * * *